US007912710B2

(12) United States Patent
Sasaki et al.

(10) Patent No.: US 7,912,710 B2
(45) Date of Patent: Mar. 22, 2011

(54) APPARATUS AND METHOD FOR CHANGING REPRODUCTION SPEED OF SPEECH SOUND

(75) Inventors: Hitoshi Sasaki, Kawasaki (JP); Hiroshi Katayama, Kawasaki (JP); Rika Nishiike, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 215 days.

(21) Appl. No.: 11/778,720

(22) Filed: Jul. 17, 2007

(65) Prior Publication Data

US 2007/0265839 A1 Nov. 15, 2007

Related U.S. Application Data

(63) Continuation of application No. PCT/JP2005/000549, filed on Jan. 18, 2005.

(51) Int. Cl.
*G10L 21/04* (2006.01)
*G10L 11/02* (2006.01)

(52) U.S. Cl. ..... 704/210; 704/215; 704/504

(58) Field of Classification Search ..... 704/210, 704/215, 253, 500, 501, 503, 504; 370/521
See application file for complete search history.

(56) References Cited

U.S. PATENT DOCUMENTS

| | | | | |
|---|---|---|---|---|
| 4,591,928 | A | 5/1986 | Bloom et al. | |
| 5,475,791 | A * | 12/1995 | Schalk et al. | 704/233 |
| 6,216,103 | B1 * | 4/2001 | Wu et al. | 704/253 |
| 6,324,509 | B1 * | 11/2001 | Bi et al. | 704/248 |
| 6,377,931 | B1 * | 4/2002 | Shlomot | 704/503 |
| 6,453,291 | B1 * | 9/2002 | Ashley | 704/233 |
| 6,711,536 | B2 * | 3/2004 | Rees | 704/210 |
| 6,885,987 | B2 * | 4/2005 | Buchholz et al. | 704/228 |
| 7,412,376 | B2 * | 8/2008 | Florencio et al. | 704/206 |
| 7,516,065 | B2 * | 4/2009 | Marumoto | 704/215 |
| 7,672,840 | B2 * | 3/2010 | Sasaki et al. | 704/215 |
| 2005/0114118 | A1 * | 5/2005 | Peck | 704/208 |
| 2005/0227657 | A1 * | 10/2005 | Frankkila et al. | 455/255 |

(Continued)

FOREIGN PATENT DOCUMENTS

EP 0 643 380 3/1995

(Continued)

OTHER PUBLICATIONS

Supplementary European Search Report dated Apr. 17, 2008, from the corresponding European Application.

(Continued)

*Primary Examiner* — Martin Lerner
(74) *Attorney, Agent, or Firm* — Katten Muchin Rosenman LLP

(57) ABSTRACT

A method for changing reproduction speed of speech sound, includes the steps of: storing an input sound signal in a buffer; leaving a sound signal from the buffer as it is or extending the sound signal from the buffer in a sound section where a power of the input sound signal exceeds a threshold value; leaving the sound signal from the buffer as it is, compressing the sound signal from the buffer, or extending the sound signal from the buffer, in a no-sound section, so that the reproduction speed of speech sound is changed; wherein a speech head protection section is set prior to the sound section being set to be a storing amount of the buffer limited by a designated limited value; and compression or deletion of the sound signal is adjusted by a compression ratio or prevented if there is the sound section in the speech head protection section, so that speech head protection is performed.

7 Claims, 10 Drawing Sheets

| DETERMINATION AND KIND OF SECTION | CONDITIONS | REPRODUCTION SPEED OF SPEECH SOUND (RATIO OF WAVE LENGTH EXTENSION) |
|---|---|---|
| SOUND | IF PROCESS DELAY TIME ≧ 1 SECOND, REPRODUCTION SPEED OF SPEECH SOUND IS SET TO BE 1-TIME (NO CHANGE) | 0.5-TIME (2-TIMES EXTENSION) |
| NO SOUND: SPEECH HEAD PROTECTION | SOUND WITHIN PROTECTION FRAME NUMBER DETERMINED BY SPEECH HEAD PROTECTION SECTION DETERMINING PART | 1-TIME (NO-CHANGE) |
| NO SOUND: SPEECH END PROTECTION | SOUND WITHIN PAST 10 FRAMES | 1-TIME (NO-CHANGE) |
| NO SOUND: PAUSE HOLDING | WITHIN (13-SPEECH HEAD PROTECTION. UPPER LIMIT = 10, LOWER LIMIT = 5) FRAMES AFTER SPEECH END PROTECTION | 1-TIME (NO-CHANGE) |
| NO SOUND: NO-SOUND DELETION | OTHER THAN ABOVE. IF NO PROCESS DELAY, SPEECH SOUND IS SET TO BE 1-TIME (NO-CHANGE) | DELETE (RATIO OF EXTENSION, 0-TIME) |

U.S. PATENT DOCUMENTS

2007/0118363 A1* 5/2007 Sasaki et al. ..... 704/214

FOREIGN PATENT DOCUMENTS

| | | |
|---|---|---|
| GB | 2 396 271 | 6/2004 |
| JP | 5-073089 | 3/1993 |
| JP | 6-337696 | 12/1994 |
| JP | 2000-305580 | 11/2000 |
| JP | 2001-056696 | 2/2001 |
| JP | 2001-222300 | 8/2001 |

OTHER PUBLICATIONS

International Search Report dated May 10, 2005, from the corresponding International Application.

* cited by examiner

FIG.2 RELATED ART

| DETERMINATION AND KIND OF SECTION | CONDITIONS | REPRODUCTION SPEED OF SPEECH SOUND (RATIO OF WAVE LENGTH EXTENSION) |
|---|---|---|
| SOUND | IF PROCESS DELAY TIME ≧ 1 SECOND, REPRODUCTION SPEED OF SPEECH SOUND IS SET TO BE 1-TIME (NO CHANGE) | 0.5-TIME (2-TIMES EXTENSION) |
| NO SOUND: SPEECH HEAD PROTECTION | SOUND WITHIN FOLLOWING 3 FRAMES | 1-TIME (NO-CHANGE) |
| NO SOUND: SPEECH END PROTECTION | SOUND WITHIN PAST 10 FRAMES | 1-TIME (NO-CHANGE) |
| NO SOUND: PAUSE HOLDING | WITHIN 10 FRAMES AFTER SPEECH END PROTECTION | 1-TIME (NO-CHANGE) |
| NO SOUND: NO-SOUND DELETION | OTHER THAN ABOVE. IF NO PROCESS DELAY, SPEECH SOUND IS SET TO BE 1-TIME (NO-CHANGE) | DELETE (RATIO OF EXTENSION, 0-TIME) |

FIG.5

| DETERMINATION AND KIND OF SECTION | CONDITIONS | REPRODUCTION SPEED OF SPEECH SOUND (RATIO OF WAVE LENGTH EXTENSION) |
|---|---|---|
| SOUND | IF PROCESS DELAY TIME ≧ 1 SECOND, REPRODUCTION SPEED OF SPEECH SOUND IS SET TO BE 1-TIME (NO CHANGE) | 0.5-TIME (2-TIMES EXTENSION) |
| NO SOUND: SPEECH HEAD PROTECTION | SOUND WITHIN PROTECTION FRAME NUMBER DETERMINED BY SPEECH HEAD PROTECTION SECTION DETERMINING PART | 1-TIME (NO-CHANGE) |
| NO SOUND: SPEECH END PROTECTION | SOUND WITHIN PAST 10 FRAMES | 1-TIME (NO-CHANGE) |
| NO SOUND: PAUSE HOLDING | WITHIN (13-SPEECH HEAD PROTECTION. UPPER LIMIT = 10, LOWER LIMIT = 5) FRAMES AFTER SPEECH END PROTECTION | 1-TIME (NO-CHANGE) |
| NO SOUND: NO-SOUND DELETION | OTHER THAN ABOVE. IF NO PROCESS DELAY, SPEECH SOUND IS SET TO BE 1-TIME (NO-CHANGE) | DELETE (RATIO OF EXTENSION, 0-TIME) |

FIG.7

| INPUT LEVEL | RESULT OF DETERMINATION |
|---|---|
| NOISE LEVEL + 4dB OR MORE | SOUND |
| NOISE LEVEL + (1～4)dB | NO-SOUND (SMALL CERTAINTY DEGREE) |
| NOISE LEVEL + LESS 1dB | NO-SOUND (LARGE CERTAINTY DEGREE) |

FIG.8

| DETERMINATION AND KIND OF SECTION | CONDITIONS | REPRODUCTION SPEED OF SPEECH SOUND (RATIO OF WAVE LENGTH EXTENSION) |
|---|---|---|
| SOUND | IF PROCESS DELAY TIME ≧ 1 SECOND, REPRODUCTION SPEED OF SPEECH SOUND IS SET TO BE 1-TIME (NO CHANGE) | 0.5-TIME (2-TIMES EXTENSION) |
| NO SOUND: SPEECH HEAD PROTECTION | SOUND WITHIN PROTECTION FRAME NUMBER DETERMINED BY SPEECH HEAD PROTECTION SECTION DETERMINING PART. OR SPEECH HEAD PROTECTION FRAME IS LESS THAN 10 AND NO-SOUND CERTAINTY IS SMALL | 1-TIME (NO-CHANGE) |
| NO SOUND: SPEECH END PROTECTION | SOUND WITHIN PAST 10 FRAMES | 1-TIME (NO-CHANGE) |
| NO SOUND: PAUSE HOLDING | WITHIN 10 FRAMES AFTER SPEECH END PROTECTION | 1-TIME (NO-CHANGE) |
| NO SOUND: NO-SOUND DELETION | OTHER THAN ABOVE. IF NO PROCESS DELAY, SPEECH SOUND IS SET TO BE 1-TIME (NO-CHANGE) | DELETE (RATIO OF EXTENSION, 0-TIME) |

FIG.10

| DETERMINATION AND KIND OF SECTION | CONDITIONS | REPRODUCTION SPEED OF SPEECH SOUND (RATIO OF WAVE LENGTH EXTENSION) |
|---|---|---|
| SOUND | IF PROCESS DELAY TIME ≧ 1 SECOND, REPRODUCTION SPEED OF SPEECH SOUND IS SET TO BE 1-TIME (NO CHANGE) | 0.5-TIME (2-TIMES EXTENSION) |
| NO SOUND: SPEECH HEAD PROTECTION | SOUND WITHIN PROTECTION FRAME NUMBER DETERMINED BY SPEECH HEAD PROTECTION SECTION DETERMINING PART. IF FOLLOWING 3 FRAMES ARE LARGE NO-SOUND CERTAINTY, NO PROTECTION | 1-TIME (NO-CHANGE) |
| NO SOUND: SPEECH END PROTECTION | SOUND WITHIN PAST 10 FRAMES | 1-TIME (NO-CHANGE) |
| NO SOUND: PAUSE HOLDING | WITHIN 10 FRAMES AFTER SPEECH END PROTECTION | 1-TIME (NO-CHANGE) |
| NO SOUND: NO-SOUND DELETION | OTHER THAN ABOVE. IF NO PROCESS DELAY, SPEECH SOUND IS SET TO BE 1-TIME (NO-CHANGE) | DELETE (RATIO OF EXTENSION, 0-TIME) |

APPARATUS AND METHOD FOR CHANGING REPRODUCTION SPEED OF SPEECH SOUND

CROSS-REFERENCE TO RELATED APPLICATION

This application is a U.S. continuation application filed under 35 USC 111(a) claiming benefit under 35 USC 120 and 365(c) of PCT application JP2005/000549, filed Jan. 18, 2005. The foregoing applications is hereby incorporated herein by reference.

BACKGROUND OF THE INVENTION

1. Field of the Invention

The present invention generally relates to apparatuses and methods for changing reproduction speeds of speech sounds. More particularly, the present invention relates to an apparatus and a method for changing reproduction speed of speech sound without changing the pitch of the sound.

2. Description of the Related Art

Conventionally and continuously techniques have been suggested wherein reproduction speed of speech sound is reduced without changing the sound pitch so that contents of conversation can be easily heard. In this case, if only the reproduction speed of speech sound is simply reduced, a delayed amount of data is generated.

In order to solve such a problem, a technique for solving the delay problem by shortening a silent section (no-sound section) existing in the conversation or by making reproduction speed of speech sound in the silent section, has been suggested.

FIG. 1 is a block diagram of an example of a related art apparatus for changing reproduction speed of speech sound. Referring to FIG. 1, a digital sound signal of a frame unit is input to a terminal 10 at one frame 20 ms so as to be supplied to a sound activity determination part 11 and a part 12 for changing reproduction speed of speech sound.

The sound activity determination part 11 analyzes a noise level at an initial silent time such as a time when conversation is started, and sets the analyzed silent level such as +4 dB as a sound threshold value. The sound activity determination part 11 compares the input sound signal and the sound threshold value and determines that a section where the sound signal is equal to or greater than the sound threshold value is a sound determining section. The sound activity determination part 11 also supplies the result of the determination to a part 13 for determining reproduction speed of speech sound.

An input storing amount computing part 14 supplies a storing amount (storing frame number) to the part 13 for determining reproduction speed of speech sound. A speech head protection section (fixed frame number) is set in the part 13 for determining reproduction speed of speech sound. The part 13 for determining reproduction speed of speech sound determines the reproduction speed of speech sound based on the result of the above-mentioned determination, the storing amount, and the speech head protection section. The part 13 for determining reproduction speed of speech sound supplies the reproduction speed of speech sound to the part 12 for changing reproduction speed of speech sound and the input storing amount computing part 14.

The part 12 for changing reproduction speed of speech sound writes an input sound signal in a buffer and reads the sound signal from the buffer based on the reproduction speed of speech sound from part 13 for determining reproduction speed of speech sound so as to output the sound signal from a terminal 15. The input storing amount computing part 14 calculates the storing amount stored in the buffer of the part 12 for changing reproduction speed of speech sound, based on the reproduction speed of speech sound from part 13 for determining reproduction speed of speech sound so as to supply the storing amount to the part 13 for determining reproduction speed of speech sound.

FIG. 2 is a table for determining reproduction speed of speech sound of the part 13 for determining reproduction speed of speech sound of the related art case.

In a sound section, the reproduction speed of speech sound is set to be 0.5 time (2-times extension). In a case where a process delay time is equal to or greater than 1 second (equal to 50 frames), the reproduction speed of speech sound is set to be 1-time.

In a speech head protection section, namely in a case where a sound determining section is provided within following 3 frames, the reproduction speed of speech sound is set to be 1-time. In a speech end protection section, namely in a case where a sound determining section is provided within past 10 frames, the reproduction speed of speech sound is set to be 1-time.

In a pause holding section, namely within 10 frames after the speech end protection, the reproduction speed of speech sound is set to be 1-time. In a section where no-sound is deleted, the sound signal is deleted other than the above-mentioned sections. If there is no process delay time, reproduction speed of speech sound is set to be 1-time.

Japanese Laid-Open Patent Application Publication No. 2001-222300 describes that speech speed of a voice section held between non-voice sections of a fixed time length or above is converted so that the speed becomes lower at its top part than the prescribed reproducing speed, and is returned gradually to the prescribed reproducing speed toward the end.

However, in the process for shortening the no-sound section or the process for decreasing the reproduction speed of speech sound in the no-sound section, it is necessary to consider precision of sound activity determination. For example, under a noisy environment, error determination may happen in the sound activity determination. Under a no noisy environment, the sound activity determination is made relatively securely even at the speech head or the speech end.

However, under the noisy environment, the noise level may be close to or exceed a power value at the speech head or the speech end. In this case, the speech head or the speech end may not be recognized due to the noise.

Because of this, under the noisy environment, it is difficult to realize the sound activity determination. For example, under the noisy environment, while a part where the voice power is small such as the speech head or no-sound consonant is in the sound section, it may be determined in error that the part is no-sound.

If a process for shortening the no-sound section or for quickening the reproducing speed based on error determination is implemented, sound may be cut or no-sound continuing length may be shortened too much.

FIG. 3 is a graph showing input speech sound signal power and speech sound signal power after the reproduction speed of speech sound is changed, in the related art case.

In FIG. 3(A), variation with time of input voice signal power (sound volume) is indicated by solid lines. Noise having a steady power level is superimposed to the sound signal and its noise level +4 dB is set as a sound threshold value. Determination results of the sections are shown at a lower part of FIG. 3(A).

A part from the speech head of the speech head protection section and a part from the speech end of the speech end protection section are shown in FIG. 3. $1^{st}$, $2^{nd}$, $5^{th}$, and $6^{th}$ voices from the left side are determined to be sound sections. On the other hand, $3^{rd}$ and $4^{th}$ voices are determined to be sections of no-sound due to noises.

While the $3^{rd}$ voice is not deleted because of protection of the speech end, the speech head of the $4^{th}$ voice is cut because the fixing speech head protection section is short. FIG. 3(B) shows sound signal power after the reproduction speed of speech sound is changed.

Section (1) of FIG. 3(B):

There are 10 frames of process delay (input storing) of change of the reproduction speed at the starting point.

Section (2) and Section (3) of FIG. 3(B):

The $1^{st}$ and $2^{nd}$ voices are determined to be sounds and therefore the ratio of wave length extension becomes 2-times extension. The reproduction speed between the section (2) and the section (3) is 1-time output due to the speech head protection and the speech end protection.

Section (4) of FIG. 3(B):

The $3^{rd}$ voice is determined to be no-sound and is in the section of the speech end protection and the pause protection. Therefore, the reproduction speed is 1-time speech.

Within the pause holding section is the no-sound section after this, the reproduction speed is 1-time speed. After this, the reproduction speed is deleted.

Section (5) of FIG. 3(B):

The 4th voice is determined to be no-sound and the speech head protection is applied to only a part. Since there is sufficient delay in change of reproduction speed (input storing amount) at this point, 1-time speed of the reproduction speed is output in the protection section. Other than this section, the reproduction speed is deleted so that the speech head is cut.

Section (6) of FIG. 3(B):

The 5th voice is determined to be the sound and therefore the ratio of wave length extension becomes 2-times extension.

In the conventional art case, since a speech head protection section having a fixed length is set in the speech head protection, it is necessary to insert or add the delay of the speech head protection. For example, sufficient speech head protection can be set in a storing sound such as answering service of the telephone. However, in a case where the reproduction speed is changed for actual communication, it is necessary to make the delay as small as possible. Therefore, in this case, it is not possible to set the speech head protection section having a sufficient length so that the speech head may be cut.

SUMMARY OF THE INVENTION

Accordingly, embodiments of the present invention may provide a novel and useful apparatus and method for changing reproduction speed of speech sound in which one or more of the problems described above are eliminated.

More specifically, the embodiments of the present invention can provide an apparatus and a method for changing reproduction speed of speech sound whereby delay can be kept to a minimum and speech head interruption can be reduced.

The embodiments of the present invention can also provide a method for changing reproduction speed of speech sound, including the steps of: storing an input sound signal in a buffer; leaving a sound signal from the buffer as it is or extending the sound signal from the buffer in a sound section where a power of the input sound signal exceeds a threshold value; leaving the sound signal from the buffer as it is, compressing the sound signal from the buffer, or extending the sound signal from the buffer, in a no-sound section, so that the reproduction speed of speech sound is changed; wherein a speech head protection section is set prior to the sound section being set to be a storing amount of the buffer limited by a designated limited value; and compression or deletion of the sound signal is adjusted by a compression ratio or prevented if there is the sound section in the speech head protection section, so that speech head protection is performed.

The embodiments of the present invention can also provide an apparatus for changing reproduction speed of speech sound, wherein an input sound signal is stored in a buffer; a sound signal from the buffer is left as it is or extended in a sound section where a power of the input sound signal exceeds a threshold value; the sound signal from the buffer is left as it is, compressed, or extended, in a no-sound section, so that the reproduction speed of speech sound is changed; the apparatus including: a speech head protection section determining part configured to set a speech head protection section prior to the sound section being set to be a storing amount of the buffer limited by a designated limited value; and the speech head protection section configured to adjust compression of the sound signal by a compression ratio or prevent deletion of the sound signal if there is the sound section in the speech head protection section, so that speech head protection is performed.

The embodiments of the present invention can also provide an apparatus for changing reproduction speed of speech sound, wherein an input sound signal is stored in a buffer; and wherein in a sound section where a power of the input sound signal exceeds a threshold value, when a sound signal read from the buffer is compressed or extended, the reproduction speed of speech sound is changed so as to be slower than that in a no-sound section where the power of the input sound signal is lower than the threshold value; the apparatus including: a speech head protection section determining part configured to set a speech head protection section, prior to the sound section being set, to be a storing amount of the buffer limited by a designated limited value; and the speech head protection section configured to adjust compression of the sound signal by a compression ratio or prevent deletion of the sound signal if there is the sound section in the speech head protection section, so that speech head protection is performed.

According to the embodiments of the present invention, it is possible to provide an apparatus and a method for changing reproduction speed of speech sound whereby delay can be kept to a minimum and speech head interruption can be reduced.

Other objects, features, and advantages of the present invention will become more apparent from the following detailed description when read in conjunction with the accompanying drawings.

BRIEF DESCRIPTION OF THE DRAWINGS

FIG. 2 is a table for determining reproduction speed of speech sound of a part for determining reproduction speed of speech sound of the related art apparatus for changing reproduction speed of speech sound;

FIG. 5 is a table for determining reproduction speed of speech sound of a part for determining reproduction speed of speech sound of the first embodiment of the present invention;

FIG. 7 is a table for determining speech sound silence of a sound activity determination part of a second embodiment of the present invention;

FIG. 8 is a table for determining reproduction speed of speech sound of a part for determining reproduction speed of speech sound of a second embodiment of the present invention;

FIG. 10 is a table for determining reproduction speed of speech sound of a part for determining reproduction speed of speech sound of a fourth embodiment of the present invention.

DETAILED DESCRIPTION OF THE PREFERRED EMBODIMENT

A description will now be given, with reference to FIG. 4 through FIG. 10, of embodiments of the present invention.

First Embodiment of the Present Invention

Figure 1:
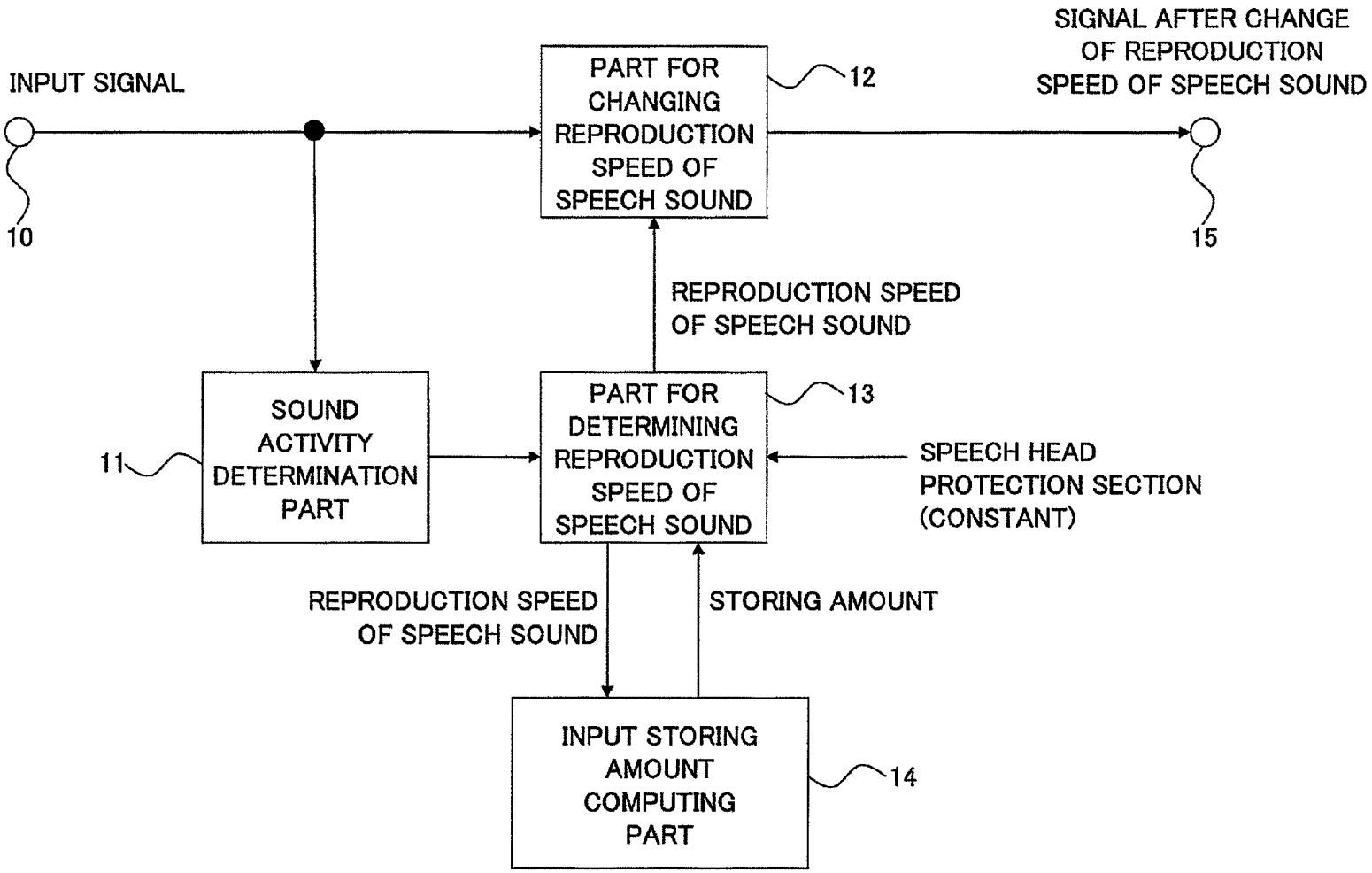
FIG.1 RELATED ART
FIG. 1 is a block diagram of an example of a related art apparatus for changing reproduction speed of speech sound.
Figure 3:
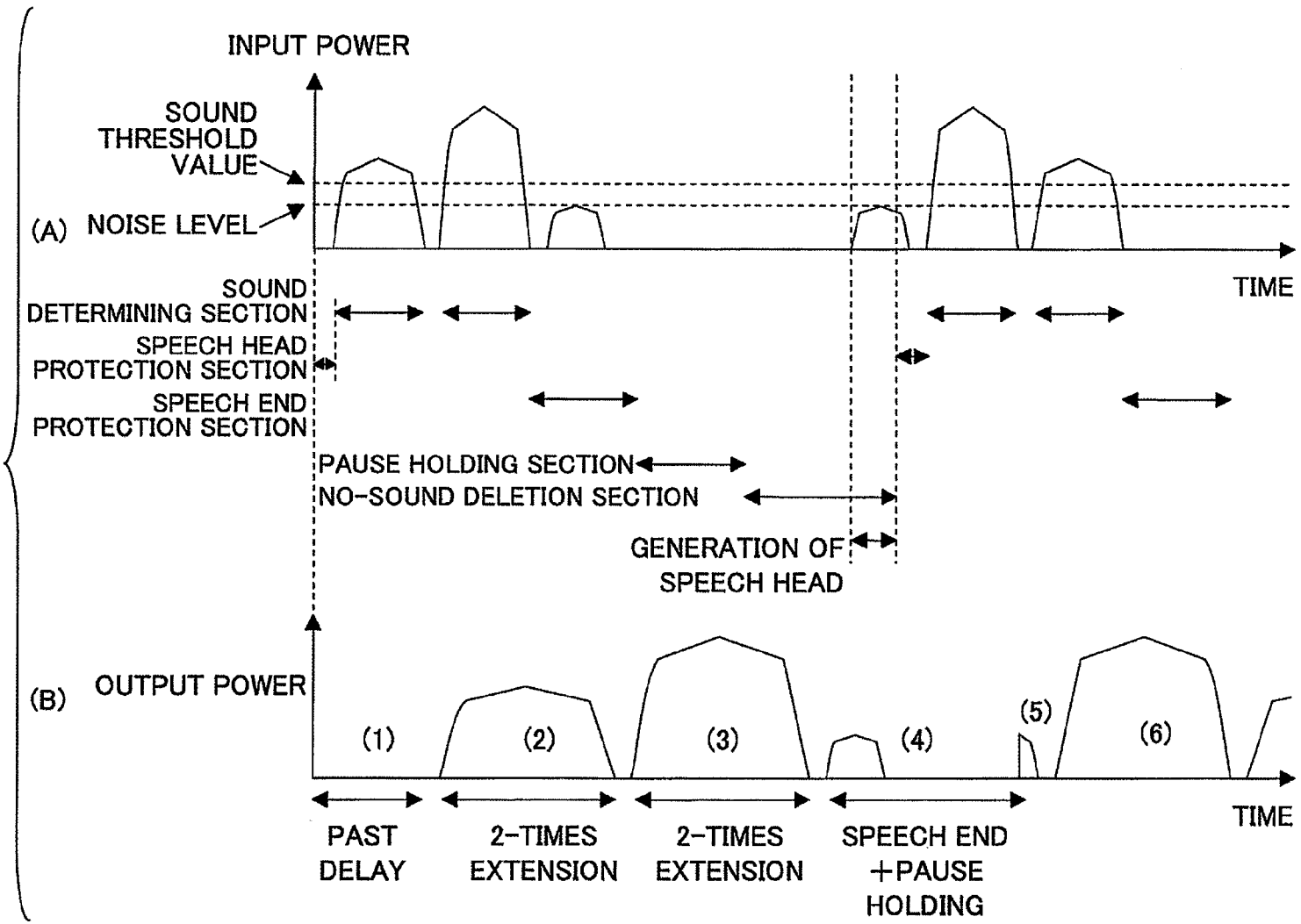
FIG.3 RELATED ART
FIG. 3 is a graph showing input speech sound signal power and speech sound signal power after the reproduction speed of speech sound is changed, in the related art case.
Figure 4:
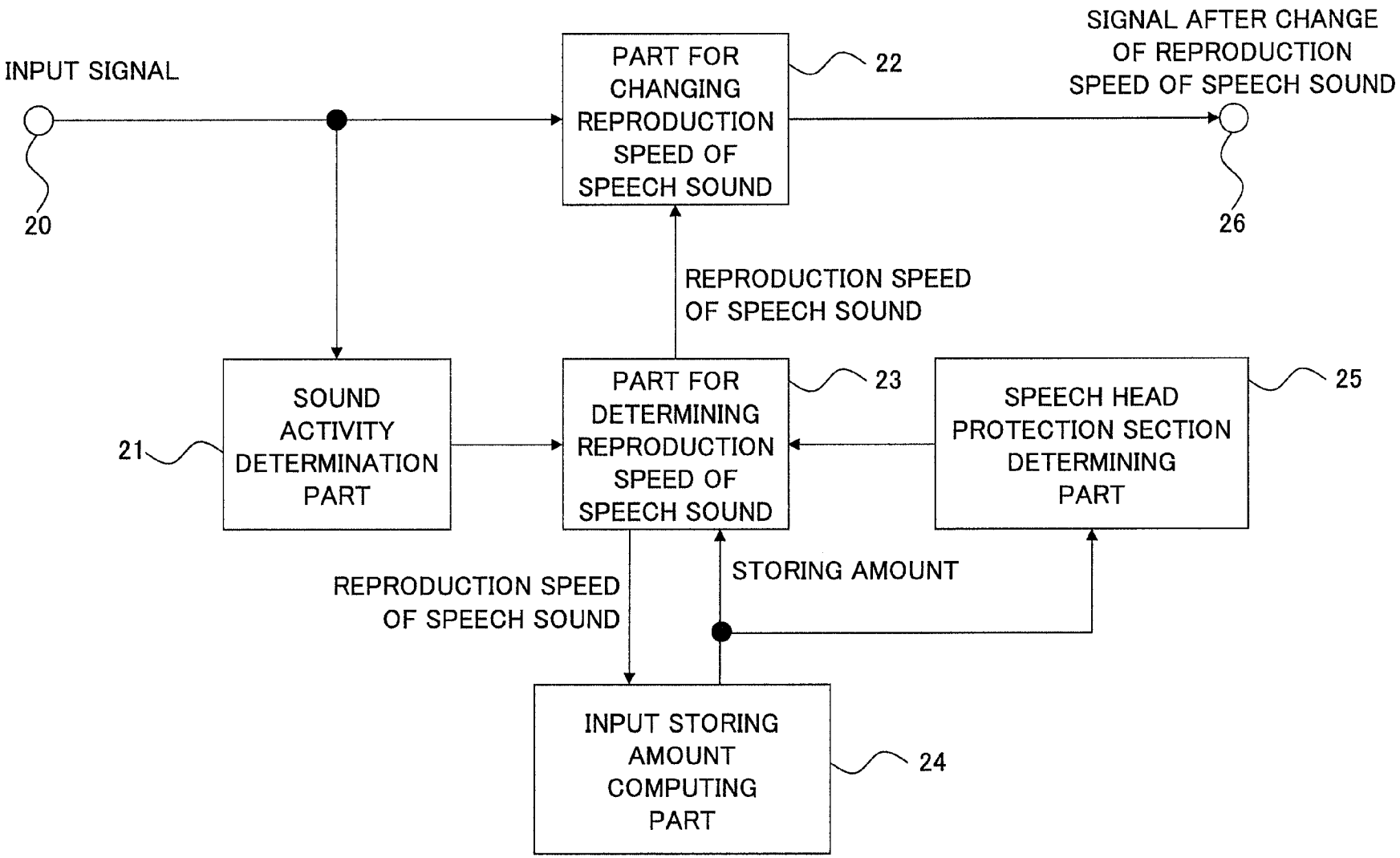
FIG. 4 is a block diagram of an apparatus for changing reproduction speed of speech sound of a first embodiment of the present invention.

FIG. 4 is a block diagram of an apparatus for changing reproduction speed of speech sound of a first embodiment of the present invention. Referring to FIG. 4, a digital sound signal of a frame unit is input to a terminal 20 at a one frame 20 ms so as to be supplied to a sound activity determination part 21 and a part 22 for changing reproduction speed of speech sound.

The sound activity determination part 21 analyzes the noise level at an initial silent time such as a time when conversation is started, and sets the analyzed silent level such as +4 dB as a sound threshold value. The sound activity determination part 21 compares the input sound signal and the sound threshold value and determines that a section where the sound signal is equal to or greater than the sound threshold value is a sound determining section. The sound activity determination part 21 also supplied the result of the determination to a part 23 for determining reproduction speed of speech sound.

While sound is determined by only power (sound volume) for convenience, it may be determined by a characteristic amount such as a frequency characteristic and a fixed value may be used as a sound threshold value.

An input storing amount computing part 24 supplies a storing amount (storing frame number) to the part 23 for determining reproduction speed of speech sound. A speech head protection section determining part 25 supplies a speech head protection section (variable frame number) that is set in the part 23 for determining reproduction speed of speech sound. The part 23 for determining reproduction speed of speech sound determines the reproduction speed of speech sound based on the result of the above-mentioned determination, the storing amount, and the speech head protection section. The part 23 for determining reproduction speed of speech sound supplies the reproduction speed of speech sound to the part 22 for changing reproduction speed of speech sound and the input storing amount computing part 24.

The part 22 for changing reproduction speed of speech sound writes an input sound signal in a buffer and reads the sound signal from the buffer based on the reproduction speed of speech sound from part 23 for determining reproduction speed of speech sound so as to output the sound signal from a terminal 26. In a deletion section, data are simply deleted. In a case where the reproduction speed is slowed, for example, each of the frames are divided into approximately 4 sub-frames and reproduction is repeatedly made based on the ratio of extension for every sub-frame. In a case of 2-times extension, each of the sub-frames is repeatedly reproduced twice. In a case of 1.5-times extension, odd-number sub-frames are reproduced one time and even number sub-frames are repeatedly reproduced twice. In this case, as discussed in Japanese Patent No. 3147562, it is general practice to use a method wherein, based on information such as correlation, smooth connection is made.

The reproduction speed changing part 22 may make the reproduction speed high and compress instead of deleting the sound signal. In a case where the reproduction speed is doubled, for example, the odd number sub-frames are reproduced one time and the even number sub-frames are deleted.

The input storing amount computing part 24 calculates the storing amount stored in the buffer of the part 22 for changing reproduction speed of speech sound, based on the reproduction speed of speech sound from part 23 for determining reproduction speed of speech sound so as to supply the storing amount to the part 23 for determining reproduction speed of speech sound and the speech head protection section determining part 25.

More specifically, in a case of the deletion, the storing amount and delay are reduced by a number of the frames to be deleted and the reproduction speed is made be 0.5-times, so that the storing amount of 20 ms per one frame is increased. The modified storing amount is used for determining the reproduction speed of the next frame.

The speech head protection section determining part 25 determines the speech head protection section (the variable frame number) corresponding to the storing amount. For example, in a case where the storing amount (corresponding to the delay of the reproduction speed change) is less than 10 frames, the storing amount (the storing frame number) equals the speech head protection section. In a case where the storing amount is greater than 10 frames, the speech head protection section equals 10 frames.

FIG. 5 is a table for determining reproduction speed of speech sound of the part 23 for determining reproduction speed of speech sound of the first embodiment of the present invention.

In a sound section, the reproduction speed of speech sound is set to be 0.5 time (2-times extension). In a case where the process delay time is equal to or greater than 1 second (equals to 50 frames), reproduction speed of speech sound is set to be 1-time.

In a speech head protection section, namely in a case where a sound determining section is provided within the frame number determined by the speech head protection section determining part 25, deletion of the sound signal is prevented and the reproduction speed of speech sound is set to be 1-time. Instead of prevention of deletion, the compression rate may be adjusted.

In a speech end protection section, namely in a case where a sound determining section is provided within the past 10 frames, the deletion of the sound signal is prevented and the reproduction speed of speech sound is set to be 1-time.

In a pause holding section, namely within N frames after the speech end protection, the deletion of the sound signal is prevented and the reproduction speed of speech sound is set to be 1-time. Here, "N" is defined as "13—the speech head protection section". The upper limitation of "N" is 10 and the lower limitation of "N" is 5.

In a section where no-sound is deleted that is a section other than each of the above-mentioned sections, the sound signal is deleted if there is process delay time. If there is no process delay time, reproduction speed of speech sound is set to be 1-time.

Figure 6:
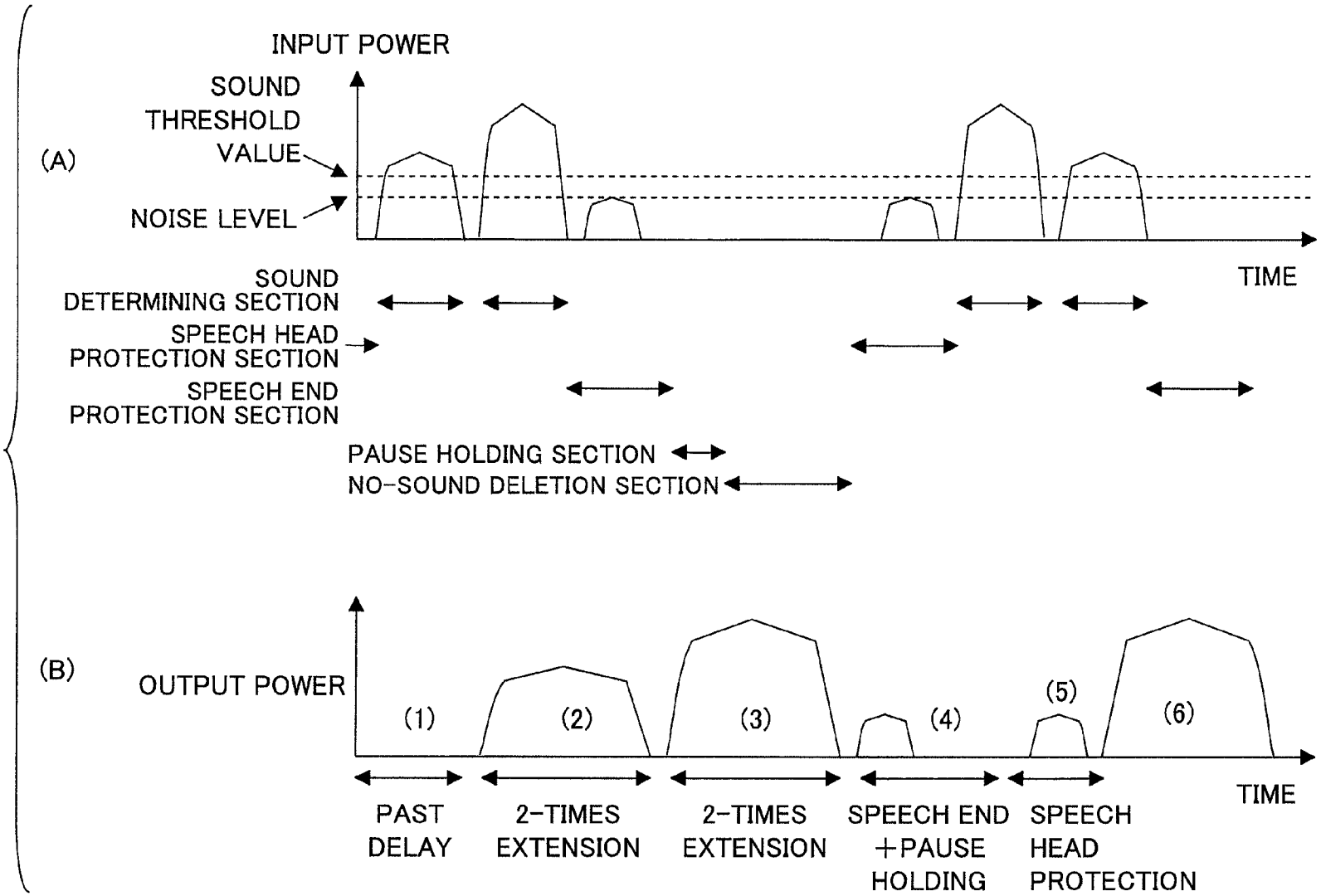
FIG. 6 is a graph showing input speech sound signal power and speech sound signal power after the reproduction speed of speech sound is changed, of the first embodiment of the present invention.

FIG. 6 is a graph showing input speech sound signal power and speech sound signal power after the reproduction speed of speech sound is changed, of the first embodiment of the present invention;

In FIG. 6(A), variation with time of input voice signal power (sound volume) is indicated by solid lines. Noise having a steady power level is superimposed on the sound signal and its noise level +4 dB is set as a sound threshold value. Determination results of the sections are shown at a lower part of FIG. 6(A).

A part from the speech head of the speech head protection section and a part from the speech end of the speech end protection section are shown in FIG. 6. $1^{st}$, $2^{nd}$, $5^{th}$, and $6^{th}$ voices from a left side are determined as sound sections. On the other hand, $3^{rd}$ and $4^{th}$ voices are determined as sections of no-sound due to noises.

FIG. 6(B) shows sound signal power after the reproduction speed of speech sound is changed.

Section (1) of FIG. 6(B):

There are 10 frames of process delay (input storing) of change of the reproduction speed at the starting point.

Section (2) and Section (3) of FIG. 6(B):

The $1^{st}$ and $2^{nd}$ voices are determined to be sounds and therefore the ratio of wave length extension becomes 2-times extension. The reproduction speed between the section (2) and the section (3) is 1-time output due to the speech head protection and the speech end protection.

Section (4) of FIG. 6(B):

In the no-sound section after the $3^{rd}$ voice, deletion is started at a point earlier by decreasing the pause holding section (one-time reproduction speed).

Section (5) of FIG. 6(B):

Since the speech head protection is increased in the fourth sound (voice), the problem of the speech head cutting is solved.

Section (6) of FIG. 6(B):

The 5th voice is determined to be sound and therefore the ratio of wave length extension becomes 2-times extension.

It is necessary to shorten the no-sound section in a case where the delay is generated, namely a case where non-processed sound signal data are stored. Therefore, it is possible to implement the speech head protection without increasing delay by setting the speech head protection section under the designated limitation corresponding to the buffer storing amount of the reproduction speech changing part 22. Furthermore, by making the pause holding section variable corresponding to the speech head protection section, it is possible to realize the speech head protection more securely than the conventional art without increasing the amount of delay when the buffer storing amount is large.

Second Embodiment of the Present Invention

In a second embodiment of the present invention, operations of the sound activity determination part 21 and the part 23 for determining reproduction speed of speech sound are different from those in the first embodiment of the present invention. Therefore, the operations of the sound activity determination part 21 and the part 23 for determining reproduction speed of speech sound are discussed here.

FIG. 7 is a table for determining speech sound silence of the sound activity determination part 21 of a second embodiment of the present invention.

The sound activity determination part 21 analyzes a noise level at an initial silent time such as a time when conversation is started, and sets the analyzed silent level such as +4 dB as a sound threshold value and the analyzed silent level such as +1 dB as a no-sound certainty degree determining value.

The sound activity determination part 21 determines that a section where the input sound signal is greater than the sound threshold value is a sound determining section. The sound activity determination part 21 determines that a section where the input sound signal is less than the sound threshold value but greater than the no-sound certainty degree determining value is a small certainty no-sound section. The sound activity determination part 21 determines that a section where the input sound signal is less than the no-sound certainty degree determining value is a large certainty no-sound section so as to supply the result of the determination to the part 13 for determining reproduction speed of speech sound.

FIG. 8 is a table for determining reproduction speed of speech sound of the part 23 for determining reproduction speed of speech sound of the second embodiment of the present invention. In a sound section, reproduction speed of speech sound is set to be 0.5 time (2-times extension). In a case where a process delay time is equal to or greater than 1 second (equals to 50 frames), deletion of the sound signal is prevented and the reproduction speed of speech sound is set to be 1-time.

In a case where the sound determining section is in the speech head protection section that is within the frame number determined by the speech head protection section determining part 25 or in a case where the frame number determined by the speech head protection section determining part 25 is less than 10 and it is in the small certainty no-sound section, the deletion of the sound signal is prevented and the reproduction speed of speech sound is set to be 1-time. Instead of prevention of deletion, a compression rate may be adjusted.

In a speech end protection section, namely in a case where a sound determining section is provided within the past 10 frames, the deletion of the sound signal is prevented and the reproduction speed of speech sound is set to be 1-time.

In a pause holding section, namely within 10 frames after the speech end protection, the deletion of the sound signal is prevented and the reproduction speed of speech sound is set to be 1-time.

In a section where no-sound is deleted that is a section other than each of the above-mentioned sections and there is process delay time, the sound signal is deleted if there is process delay time. If there is no process delay time, reproduction speed of speech sound is set to be 1-time.

Thus, in a case where the speech head protection section is less than 10 frames, it is possible to prevent the speech head cutting in a case where the speech head protection section is relatively short, by deleting the reproduction speed or making the reproduction speed be a subject of one-time speed when the no-sound reliability of the present frame is high.

Third Embodiment of the Present Invention

Figure 9:
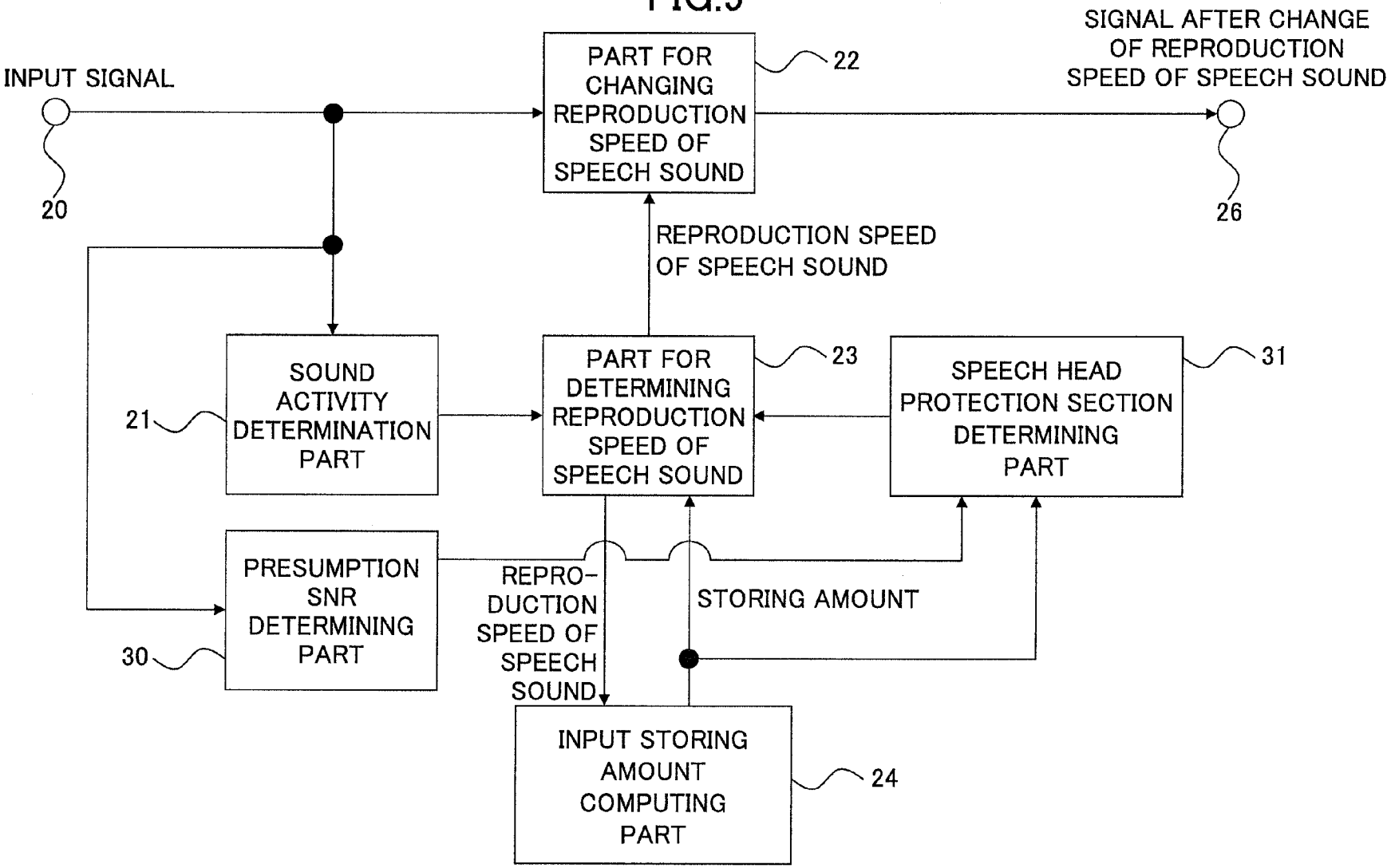
FIG. 9 is a block diagram of an apparatus for changing reproduction speed of speech sound of a third embodiment of the present invention.

FIG. 9 is a block diagram of an apparatus for changing reproduction speed of speech sound of a third embodiment of the present invention. In FIG. 9, parts that are the same as the parts shown in FIG. 4 are given the same reference numerals.

Referring to FIG. 9, a digital sound signal of a frame unit is input to a terminal 20 at a one frame 20 ms so as to be supplied to a sound activity determination part 21, the part 22 for changing reproduction speed of speech sound, and a presumption SNR computing part 30.

The sound activity determination part 21 analyzes a noise level at an initial silent time such as a time when conversation is started, and sets the analyzed silent level such as +4 dB as a sound threshold value. The sound activity determination part 21 compares the input sound signal and the sound threshold value and determines that a section where the sound signal is equal to or greater than the sound threshold value is a sound determining section. The sound activity determination part 21 also supplies the result of the determination to a part 23 for determining reproduction speed of speech sound.

While sound is determined by only power (sound volume) for convenience, it may be determined by a characteristic amount such as a frequency characteristic and a fixed value may be used as a sound threshold value.

The presumption SNR determining part 30 presumes an SNR (signal-to-noise ratio) and determines whether presumed SNR is high or low. As a presumption determining method of the SNR, for example, the difference of maximum power (sound volume) or minimum volume of the past 30 seconds is computed and if the difference exceed the threshold value (15 dB, for example), it is regarded the presumption SNR is high. If it is less than the threshold value, it is regarded as the presumption SNR is low.

An input storing amount computing part 24 supplies a storing amount (storing frame number) to the part 23 for determining reproduction speed of speech sound. A speech head protection section determining part 25 supplies a speech head protection section (variable frame number) is set in the part 23 for determining reproduction speed of speech sound. The part 23 for determining reproduction speed of speech sound determines the reproduction speed of speech sound based on the result of the above-mentioned determination, the storing amount, and the speech head protection section. The part 23 for determining reproduction speed of speech sound supplies the reproduction speed of speech sound to the part 22 for changing reproduction speed of speech sound and the input storing amount computing part 24.

The part 22 for changing reproduction speed of speech sound writes an input sound signal in a buffer and reads the sound signal from the buffer based on the reproduction speed of speech sound from part 23 for determining reproduction speed of speech sound so as to output the sound signal from a terminal 26. In a deletion section, data are simply deleted. In a case where the reproduction speed is reduced, for example, each of the frames is divided into approximately 4 sub-frames and reproduction is repeatedly done based on the ratio of extension for every sub-frame. In a case of 2-times extension, each of the sub-frames is repeatedly reproduced twice. In a case of 1.5-times extension, odd-number sub-frames are reproduced one time and even number sub-frames are repeatedly reproduced twice.

The input storing amount computing part 24 calculates the storing amount stored in the buffer of the part 22 for changing reproduction speed of speech sound, based on the reproduction speed of speech sound from part 23 for determining reproduction speed of speech sound so as to supply the storing amount to the part 23 for determining reproduction speed of speech sound and the speech head protection section determining part 25.

The speech head protection section determining part 31 determines the speech head section (variable frame number) corresponding to the presumption SNR and the storing amount. For example, in a case where the presumption SNR is low, if the storing amount (corresponding to the delay of the reproduction speed change) equals less than 10, the storing amount (storing frame number) is the speech head protection section. If the storing amount is larger than 10, the speech head protection section equals 10 frames.

In a case where the presumption SNR is high, if the storing amount is less than 3, the storing amount (storing frame number) equals the speech head protection section. If the storing amount is larger than 3, the speech head protection section equals 3 frames.

In the third embodiment of the present invention, in the case where the presumption SNR is high, it may not be determined that the speech head is no-sound in error. Therefore, it is possible to prevent the protection section from being set excessively.

Fourth Embodiment of the Present Invention

In a fourth embodiment of the present invention, operations of the sound activity determination part 21 and the part 23 for determining reproduction speed of speech sound are different from those in the third embodiment of the present invention. Therefore, the operations of the sound activity determination part 21 and the part 23 for determining reproduction speed of speech sound are discussed here.

The sound activity table of the sound activity determining part 21 of the fourth embodiment of the present invention is the same as that shown in FIG. 7.

The sound activity determination part 21 analyzes a noise level at an initial silent time such as a time when conversation is started, and sets the analyzed silent level such as +4 dB as a sound threshold value and the analyzed silent level such as +1 dB as a no-sound certainty degree determining value.

The sound activity determination part 21 determines that a section where the input sound signal is greater than the sound threshold value is a sound determining section. The sound activity determination part 21 determines that a section where the input sound signal is less than the sound threshold value but greater than the no-sound certainty degree determining value is a small certainty no-sound section. The sound activity determination part 21 determines that a section where the input sound signal is less than the no-sound certainty degree determining value is a large certainty no-sound section so as to supply the result of the determination to the part 23 for determining reproduction speed of speech sound.

FIG. 10 is a table for determining reproduction speed of speech sound of the part 23 for determining reproduction speed of speech sound of the fourth embodiment of the present invention.

In a sound section, reproduction speed of speech sound is set to be 0.5 time (2-times extension). In a case where a process delay time is equal to or greater than 1 second (equals to 50 frames), reproduction speed of speech sound is set to be 1-time.

In a speech head protection section, namely in a case where a sound determining section is provided within the frame number determined by the speech head protection section determining part 25, deletion of the sound signal is prevented and the reproduction speed of speech sound is set to be 1-time. If the present frame and the following 3 frames are the large certainty no-sound section, the speech head protection is not made.

In a speech end protection section, namely in a case where a sound determining section is provided within the past 10 frames, the deletion of the sound signal is prevented and the reproduction speed of speech sound is set to be 1-time. Instead of prevention of deletion, the compression rate may be adjusted.

In a pause holding section, namely within 10 frames after the speech end protection, the deletion of the sound signal is prevented and the reproduction speed of speech sound is set to be 1-time.

In a section where no-sound is deleted and it is a section other than each of the above-mentioned sections, the sound signal is deleted if there is process delay time. If there is no process delay time, reproduction speed of speech sound is set to be 1-time.

In the fourth embodiment of the present invention, if the present frame and the following three frames have large certainty of the no-sound, it may not be determined that the speech head is no-sound in error. Therefore, it is possible to prevent the protection section from being set excessively.

The speech head protection section determining part 25 or 31 corresponds to a speech head protection section determining part of claims, the part 23 for determining reproduction speed of speech sound corresponds to a speech head protection part and a pause section setting part of claims, the sound activity determining part 21 corresponds to a no-sound certainty degree determining part of claims, and the presumption SNR determining part 30 corresponds to a signal to noise presumption part of claims.

The present invention is not limited to these embodiments, but variations and modifications may be made without departing from the scope of the present invention.

What is claimed is:

1. A method for changing reproduction speed of speech sound, comprising:

storing an input sound signal in a buffer;

leaving a sound signal from the buffer as it is or extending the sound signal from the buffer in a sound section where a power of the input sound signal exceeds a threshold value; and leaving the sound signal from the buffer as it is, compressing the sound signal from the buffer, or deleting the sound signal from the buffer, in a no-sound section, so that the reproduction speed of speech sound is changed, wherein a speech head protection section is set prior to the sound section being set to be a storing amount of the buffer if the storing amount of the buffer is less than a designated amount, the speech head protection section is set to be the designated amount if the storing amount of the buffer is greater than the designated amount, compression or deletion of the sound signal is adjusted by a compression ratio or prevented if there is the sound section in the speech head protection section, so that speech head protection is performed, a pause holding section is set after a speech end protection section having a designated length and following the sound section is ended, and a length of the pause holding section is set corresponding to the length of the speech head protection section.

2. The method for changing reproduction speed of speech sound, as claimed in claim 1, wherein a no-sound certainty degree is determined in a no-sound section where the power of the input sound signal is less than the threshold value; and compression or deletion of the sound signal is adjusted by a compression ratio or prevented if the no-sound certainty degree of the no-sound section in the speech head protection section is low, so that speech head protection is performed.

3. The method for changing reproduction speed of speech sound as claimed in claim 1, wherein a signal to noise ratio of the input sound signal is presumed; and setting the designated limited value in the speech head protection section when the presumed signal to noise ratio is higher than a constant value and setting a value smaller than the designated limited value in the speech head protection section when the presumed signal to noise ratio is lower than the constant value.

4. An apparatus configured to change reproduction speed of speech sound, comprising:

a changing reproduction speed part configured to store an input sound signal in a buffer, the changing reproduction speed part configured to leave a sound signal from the buffer as it is or delete the sound signal from the buffer, in a sound section where a power of the input sound signal exceeds a threshold value, the changing reproduction speed part configured to leave the sound signal from the buffer as it is, compress or extend the sound signal from the buffer, in a no-sound section, so that the reproduction speed of speech sound is changed;

a speech head protection section determining part configured to set a speech head protection section prior to the sound section being set to be a storing amount of the buffer if the storing amount of the buffer is less than a designated amount, the speech head protection section determining part configured to set the speech head protection section prior to the sound section being set to be the designated amount if the storing amount of the buffer is greater than the designated amount; and a pause holding section setting part configured to set a pause holding section after a speech end protection section having a designated length and following the sound section is ended, wherein compression of the sound signal is adjusted by a compression ratio or deletion of the sound signal is prevented if there is the sound section in the speech head protection section, so that speech head protection is performed, and a length of the pause holding section is set corresponding to the length of the speech head protection section.

5. The apparatus configured to change reproduction speed of speech sound, as claimed in claim 4, further comprising:

a no-sound certainty degree determining part configured to determine a no-sound certainty degree in a no-sound section where the power of the input sound signal is less than the threshold value; and the speech head protection section adjusts compression of the sound signal by the compression ratio or prevents deletion of the sound signal if the no-sound certainty degree of the no-sound section in the speech head protection section is low, so that speech head protection is performed.

6. The apparatus configured to change reproduction speed of speech sound, as claimed in claim 4, further comprising:

a signal to noise presumption part configured to presume a signal to noise ratio of the input sound signal;

wherein the speech head protection section determining part sets the designated limited value in the speech head protection section when the presumed signal to noise ratio is higher than a constant value and sets a value smaller than the designated limited value in the speech head protection section when the presumed signal to noise ratio is lower than the constant value.

7. An apparatus configured to change reproduction speed of speech sound, comprising:

a changing reproduction speed part configured to store an input sound signal in a buffer, the changing reproduction speed part configured to, in a sound section where a power of the input sound signal exceeds a threshold value, change the reproduction speed of speech sound when a sound signal read from the buffer is extended, so that the reproduction speed of speech sound that is changed is slower than that in a no-sound section where the power of the input sound signal is lower than the threshold value;

a speech head protection section determining part configured to set a speech head protection section prior to the sound section being set to be a storing amount of the buffer if the storing amount of the buffer is less than a designated amount, the speech head protection section determining part configured to set the speech head protection section prior to the sound section being set to be the designated amount if the storing amount of the buffer is greater than the designated amount; and a pause holding section setting part configured to set a pause holding section after a speech end protection section having a designated length and following the sound section is ended, wherein compression of the sound signal is adjusted by a compression ratio or deletion of the sound signal is prevented if there is the sound section in the speech head protection section, so that speech head protection is performed, and a length of the pause holding section is set corresponding to the length of the speech head protection section.

* * * * *